US006096137A

United States Patent [19]

Mabuchi et al.

[11] Patent Number: 6,096,137

[45] Date of Patent: Aug. 1, 2000

[54] PICKLING PLANT AND METHOD OF CONTROLLING THE SAME

[75] Inventors: Katsumi Mabuchi, Hitachi; Tomoko Kikuchi, Hitachinaka; Yasunobu Kani, Hitachi; Tsuneo Nakamura, Hitachi; Shinichi Yokosuka, Hitachi, all of Japan

[73] Assignee: Hitachi, Ltd., Tokyo, Japan

[21] Appl. No.: 09/033,243

[22] Filed: Mar. 3, 1998

[30] Foreign Application Priority Data

Mar. 3, 1997 [JP] Japan ..... 9-047570

[51] Int. Cl.[7] ..... B08B 1/02; B08B 3/08; C23G 1/02; C23G 1/08; C23G 3/02

[52] U.S. Cl. ..... 134/3; 134/9; 134/15; 134/18; 134/41; 134/28; 134/32

[58] Field of Search ..... 134/3, 15, 9, 18, 134/41, 28, 32

[56] References Cited

FOREIGN PATENT DOCUMENTS 59-209415 11/1984 Japan .

62-196385 8/1987 Japan .

1-254313 10/1989 Japan .

6-212462 8/1994 Japan .

*Primary Examiner*—Zeinab El-Arini

*Attorney, Agent, or Firm*—Antonelli, Terry, Stout & Kraus, LLP

[57] ABSTRACT

A pickling plant for a steel strip and a method for controlling the pickling plant, including monitoring at least one quantity of state represented by thickness, width and quantity of scale of the steel strip, and at least one quantity of state of operation of a plant represented by concentration, quantity and temperature of acid supplied into a pickling tank of the pickling plant, line speed of the steel strip, and temperature of the steel strip immediately before entering the pickling tank calculating on the basis of values of said quantity of state and quantity of state of operation, at least one of concentration distribution of acid, concentration distribution of iron and descaling rate at optional plural positions, and on the basis of the calculating the optimum quantity of state for operation of the plant is determined.

14 Claims, 12 Drawing Sheets

| PICKLING PARAMETER | VALUES |
|---|---|
| SCALE AMOUNT X(0)(g/m$^2$) | 0.07 |
| STRIP THICKNESS t(m) | 0.0035 |
| STRIP WIDTH h(m) | 1 |
| INITIAL CONCENTRATION OF HCL ACID C(0)(g/1)<br>TEMPERATURE OF HCL ACID SOLUTION T(°C)<br>FOLW RATE OF HCL ACID SOLUTION Q(0)(kg/min) | 180<br>85<br>80 |
| STRIP RUNNING SPEED V(m/min) | 300 |
| LENGTH OF A LINE l(m) | 90.2 |

PICKLING PLANT AND METHOD OF CONTROLLING THE SAME

BACKGROUND OF THE INVENTION

The present invention relates to a pickling plant for removing oxide scale on the surface of a fresh hot-rolled steel strip, a method of controlling the same, a continuous through production process for descaling and cold rolling of a plain carbon steel strip, and a continuous through production equipment of descaling and cold rolling of such steel strip.

In general, since the plain carbon steel is rolled at temperatures from 800 to 900° C., oxide scale of black color comprising $Fe_3O_4$ as a major component may be produced. The scale is pressed into the surface layer of the steel strip during a following cold rolling process to cause a scale scratch on the strip. Thus, scale should be indispensably removed. The catenary type pickling process is most widely used as a method of removing scale from the plain carbon steel strip, in which a steel strip is dipped in a tank containing a solution of hydrochloric acid and continuously passed through the tank to remove the scale by chemical reaction. The hydrochloric acid solution is supplied into the tank from the downstream side of the running strip and discharged from the upstream side thereof, wherein the acid concentration of the hydrochloric acid pickling solution is decreased to approximately 3 to 5%, while the concentration of $FeCl_2$ is increased an order of ten and several percent. The solution is recycled to a hydrochloric acid solution having a concentration of about 18% through the ARP (acid-recovering system) and is led to the downstream side of the pickling tank. In general, the capacity of the ARP is set on the basis of the Fe ion concentration of 120 g/liter in the pickling solution recovered from the downstream. The value of 120 g/liter corresponds to the concentration of Fe ion contained in the pickling solution when all the scale is entirely dissolved just at the downstream side end of the pickling tank with respect to the running strip.

In the case where the line speed is required to be slowed down, studying an unusual operation, for example, if the temperature of the pickling solution remains unchanged as it is, descaling is completed prior to the down stream side end of the picking tank with respect to the running strip resulting in that the steel of the exposed base surface of the steel strip is immersed in the acid solution for a too long time, which is called as "over picking" because the immersion time of the steel in the pickling solution is prolonged. In such the case, not only the base surface of the steel is roughened to deteriorate the quality of the product, but also the pickling solution is consumed too much and deteriorated unsuitably. On the other hand, in the case where steel strips different in thickness of scale to one another is introduced into the production line, there is a possibility that a steel strip having a thick oxide film goes out of the pickling tank without completion of descaling, while a steel strip having a thin oxide film is subjected to over pickling like the case where the line speed is slowed down, provided that the operating conditions are the same to one another.

In the known practice, it has not yet been established how to handle the above respective cases. For example, in the case where the line speed is decreased, operating conditions have been determined in accordance with experiences such as effectively lowering the operation temperature. But, it has not been clear how low the operation temperature in pickling should be, and an optimum operating condition has been determined in accordance with observation of the surface state of the steel strip which comes out from the pickling tank.

JP-A-59-209415 discloses a descaling method in which the pickling speed is controlled on the basis of coiling temperature of a hot rolled steel strip. JP-A-62-196385 discloses a descaling method in which a hot rolled steel strip is passed through molten salt and subsequently subjected to pickling, wherein the flow rate of the acid solution supplied in the pickling tank is controlled on the basis of the temperature of the steel strip before entering into the molten salt. JP-A-1-254313 discloses a descaling method in which, when a hot rolled steel strip is subjected to pickling, the supply rate of the acid solution from a nozzle into the pickling tank is controlled on the basis of the thickness and a material type of the strip and hot rolled conditions of the strip. JP-A-6-212462 discloses a pickling method in which the concentration and the temperature of the acid solution are changed on the basis of the state of the oxide film on the surface of the steel strip. However, none of the above publications teaches a distribution of acid concentration in the pickling tank, a distribution of Fe ion concentration in the pickling tank and an efficiency of descaling.

SUMMARY OF THE INVENTION

The object of the invention is to provide an algorithm in the optimum method of controlling a pickling plant for obtaining a plain carbon steel strip having excellent smoothness after descaling, a pickling plant accompanied with the algorithm, a continuous through production process of descaling and cold rolling for a plain carbon steel strip with utilization of the pickling plant, and an equipment of performing the process.

In order to change the controlling method relied on a rule of experience to that on the basis of a calculation algorithm, it is required to formulate relationships among conditions of operating a plant, quantity of state of the steel strip and descaling rate and to determine the conditions of operating the plant so as to make the cumulative descaling rate around the outlet of the pickling tank to be 100%.

The optimum operating conditions in an ordinary operation may be controlled by values determined in accordance with the algorithm. In the case where operating conditions (for example, the line speed, a thickness and a width of the steel strip, an amount of scale and so on) are changed, the plant may be operated under optimum operating conditions on the basis of a calculation of a changing extent of operating conditions for the plant (such as solution temperature, the concentration and amount of hydrochloric acid supplied from the ARP) with utilization of the algorithm.

According to a first aspect of the invention, there is provided a method of controlling a pickling plant, which comprises monitoring a quantity of state of a steel strip represented by a thickness, a width and a scale amount of the steel strip, and at least one of quantities of state of operation comprising a concentration, a supply amount of the acid solution and temperature of an acid solution which is supplied to a pickling tank containing the acid solution, a line speed, and temperature of the steel strip just before entering the pickling tank; calculating at least one of a concentration distribution of acid, a concentration distribution of Fe ion and a descaling rate at a plurality of optional positions in the pickling tank on the basis of values of the above actual quantities of state of operation; and determining quantities of state of operation with regard to the pickling plant.

In one embodiment of the method of controlling the pickling plant, at least one of an acid concentration of the acid solution, Fe ion of the acid solution, temperature of the acid solution and a descaling rate is monitored at a plurality of optional positions. An amount of consumed acid is a function of the temperature and the acid concentration on the basis of a result of previously conducted descaling tests at various temperatures and various acid concentrations of the acid solution. The quantities of state of operation are determined so as to make the cumulative descaling rate around the outlet of the pickling tank to be 100%.

According to a second aspect of the invention, there is provided a method of controlling a pickling plant, which comprises monitoring a quantity of state of a steel strip represented by a thickness, a width and a scale amount of the steel strip, and quantities of state of operation comprising a concentration, a supply amount of the acid solution and temperature of an acid solution which is supplied to a pickling tank containing the acid solution, a line speed, and temperature of the steel strip just before entering the pickling tank; calculating material balances of acid at a plurality of optional positions with regard to flowing-in acid, flowing-out acid and consumed acid at respective positions on the basis of the quantities of state of operation; calculating a descaling amount at the respective position on the basis of the calculated material balance; and further calculating a descaling rate, optionally a concentration distribution of acid and optionally a concentration distribution of Fe ion at the respective plural optional positions by cyclicly repeating the former calculation; determining quantities of state of operation with regard to the pickling plant on the basis of values obtained by the above latter calculation; and operating the pickling plant on the basis of the determined quantities of state of operation.

According to a third aspect of the invention, there is provided a pickling plant which comprises a first sensor monitoring a quantity of state of a steel strip represented by a thickness, a width and a scale amount of the steel strip; a second sensor monitoring quantities of state of operation comprising a concentration, a supply amount of the acid solution and temperature of an acid solution which is supplied to each of a plurality of pickling tanks containing the acid solution, a line speed, and temperature of the steel strip just before entering the pickling tank; a calculator which calculates material balances of acid at a plurality of optional positions in the respective pickling tanks, which are flowing-in acid, flowing-out acid and consumed acid at respective positions, thereby calculates respective acid concentrations at the plural positions thereby calculating a descaling amount and further calculates a descaling rate, optionally a concentration distribution of acid and optionally a concentration distribution of Fe ion at the respective plural optional positions by cyclicly repeating the former calculation; and a control device by which quantities of state of operation with regard to the pickling plant are controlled on the basis of the output value of the calculator.

According to a fourth aspect of the invention, there is provided a method of controlling the pickling plant in which quantities of state of operation and those of a steel strip vary during operation of the pickling plant, where the quantities of state of operation are of an acid concentration, a supply amount and temperature of an acid solution which is supplied to a pickling tank, and a line speed, and where the quantities of a steel strip are of a thickness, a width and a scale amount of the steel strip, wherein the quantities of state of operation are determined on the basis of an amount of acid consumed at respective optional positions in the pickling tank, the amount of consumed acid being calculated from a relationship between flowing-in acid and flowing-out acid at the respective optional positions.

In the method of controlling the pickling plant in which quantities of state of operation and those of a steel strip vary during operation of the pickling plant, it is preferable to change at least one of the quantities of state of operation which are the acid concentration, the supply amount and temperature of the acid solution, and the line speed.

The invention method of controlling a pickling plant comprises monitoring the quantity of state of a steel strip represented by a thickness, a width and a scale amount of the steel strip, and at least one of quantities of state of operation comprising a concentration, a supply amount of the acid solution and temperature of the acid solution which is supplied to the pickling tank containing the acid solution, a line speed, and temperature of the steel strip just before entering the pickling tank; calculating the material balance of acid at an optional position in the pickling tank with regard to flowing-in acid, flowing-out acid and consumed acid at the optional position on the basis of the quantities of state of operation; calculating a descaling amount at the optional position on the basis of the calculated material balance; and further calculating a descaling rate, optionally a concentration distribution of acid and optionally a concentration distribution of Fe ion at the optional position by cyclicly repeating the above-identified two calculating steps; determining quantities of state of operation with regard to the pickling plant on the basis of values obtained by the above latter, further calculation; and operating the pickling plant on the basis of the determined quantities of state of operation.

According to a fifth aspect of the invention, there is provided a continuous through production equipment of descaling and cold rolling, which comprises a mechanical scale breaker by which a hot-rolled plain carbon steel strip is mechanically descaled from the surface thereof; and a pickling plant comprising a plurality of pickling tanks each of which contains a dilute hydrochloric acid solution, and further comprising means of causing the dilute hydrochloric acid solution to flow from the downstream side to the upstream side in the respective pickling tanks with respect to the running direction of the steel strip, wherein the pickling plant is that defined in the above third aspect of the invention. The continuous through production equipment of descaling and cold rolling can comprise a cold strip mill of rolling the plain carbon steel strip from the pickling plant.

According to a sixth aspect of the invention, there is provided a descaling continuous through production equipment, which comprises a continuous casting machine of producing a thin plate casting of plain carbon steel; a hot strip mill of rolling the thin plate casting; a mechanical scale breaker by which the hot-rolled plain carbon steel strip is mechanically descaled from the surface thereof; a pickling plant comprising a plurality of pickling tanks each of which contains a dilute hydrochloric acid solution, means of dipping and passing the descaled plain carbon steel strip in and through the pickling tanks, heating means for the dilute hydrochloric acid solution in the pickling tanks, and means of causing the dilute hydrochloric acid solution to flow from the downstream side to the upstream side in the respective pickling tanks with respect to the running direction of the steel strip; water-cleaning means for the steel strip from the pickling plant: and drying means for the water-cleaned steel strip, wherein the pickling plant is that being defined in the above third aspect of the invention. The continuous through production equipment of descaling can comprise a cold strip mill of rolling the plain carbon steel strip from the drying means.

The invention method of controlling a pickling plant comprises rolling plain carbon steel by a hot strip mill, and descaling the plain carbon steel strip from the hot strip mill by pickling as described above.

According to a seventh aspect of the invention, there is provided a descaling continuous through production process for a plain carbon steel strip, which comprises controlling a pickling plant wherein plain carbon steel is rolled by a hot strip mill and descaling the plain carbon steel strip from the hot strip mill by pickling, and wherein the descaling is performed mechanically, pickling is performed as described above, and the pickled plain carbon steel strip is cold-rolled.

According to an eighth aspect of the invention, there is provided a descaling equipment for a hot-rolled plain carbon steel strip, which comprises means of supplying a plain carbon steel strip which is rolled by a hot strip mill; a shearing device of shearing the steel strip to have a desired length, means of providing mechanical stress to scale on the steel strip; a plurality of tanks containing an acid solution which is brought into contact with the steel strip; a pickling plant in which the steel strip is descaled by dipping and passing the steel strip in and through the acid solution in the tanks; water-cleaning means for the steel strip from the pickling plant; and drying means for the water-cleaned steel strip, wherein the pickling plant is that defined in the above third aspect of the invention.

DETAILED DESCRIPTION OF THE INVENTION

Figure 1:
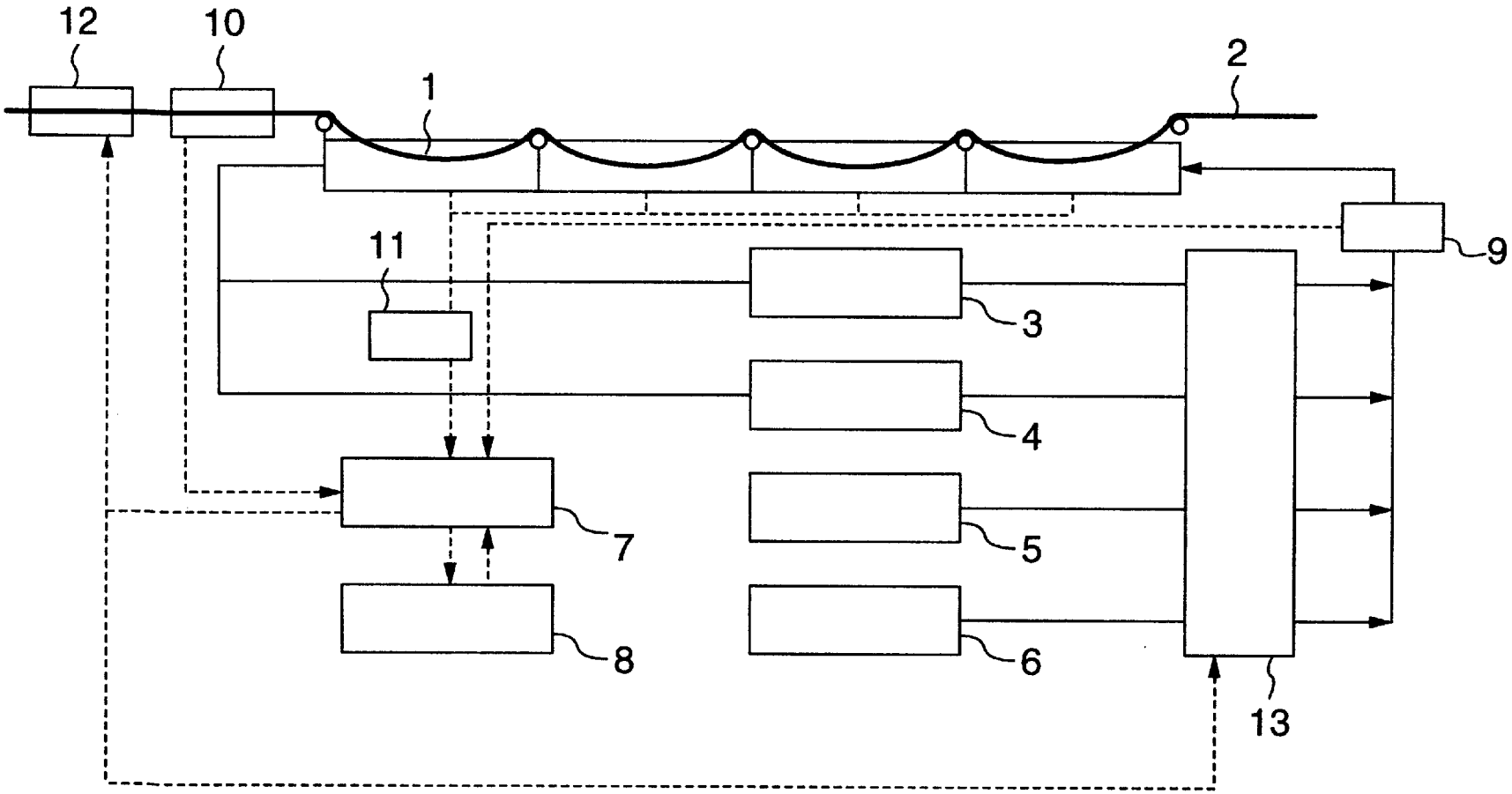
FIG. 1 is a schematic drawing of an embodiment of the invention pickling plant of a descaling process for a steel strip.

In order to conduct a control in accordance with a calculation algorithm, it is required to formulate relationships among operating conditions for the plant and quantities of state of a steel strip and descaling rate. Accordingly, a concentration of hydrochloric acid, an amount of descaling, an amount of Fe, etc. can be obtained by dividing a pickling tank into a plurality of sections and calculating material balances of acid at the sections. The algorithm herein is described below.

A study is made herein supposed that the pickling tank consists of "n" sections (sectional tanks).

From the inlet of the pickling tank, each length of the sections is expressed by $l_1, l_2, \ldots l_n$, concentration of acid is expressed by $C_1, C_2, \ldots C_n$, an average temperature of steel strip is expressed by $t_1, t_2 \ldots t_n$, a travelling time of strip is expressed by $\tau_1, \tau_2 \ldots \tau_n$, an initial temperature of strip is expressed by $\theta(0)$, temperature of solution is expressed by $\theta(f)$, an amount of scale is expressed by X (0), a line speed is expressed by V, heat transfer coefficient is expressed by "$\alpha$", specific heat is expressed by C (1), a concentration of acid supplied from the ARP is expressed by $C_{n+1}$, a supply amount of HCl solution is expressed by Q, a width of steel strip is expressed by "h", and a thickness of steel strip is expressed by "t". The average travelling time of strip at each section is as follows:

$$\tau_1 = l_1 / V \tag{1}$$

$$\tau_n = l_n / V \tag{2}$$

The temperature of steel can be obtained by the following equations.

When temperatures of the inlet and the outlet of the first section are expressed by $T_0$ and $T_1$, respectively, and temperatures of the outlet and the inlet of the second section are expressed by $T_1$ and $T_2$, respectively, and temperatures of the outlet and the inlet of the n-th section are expressed by $T_{n-1}$ and Tn, respectively, $$T_0 = \theta_0 \tag{3}$$

$$T_1 = \theta_f - (\theta_f - \theta_0) \times \exp^{(-2\times\alpha\times l_1/(C_V\times d\times V\times 60\times 7850)} \tag{4}$$

$$T_2 = \theta_f - (\theta_f - \theta_0) \times \exp^{(-2\times\alpha\times(l_1+l_2)/(C_V\times d\times V\times 60\times 7850)} \tag{5}$$

$$T_n - 1 = \theta_f - (\theta_f - \theta_0) \times \exp^{(-2\times\alpha\times(l_1+l_2+l_3 \cdots +l_{n-1})/(C_V\times d\times V\times 60\times 7850)} \tag{6}$$

$$T_n = \theta_f - (\theta_f - \theta_0) \times \exp^{(-2\times\alpha\times(l_1+l_2+l_3 \cdots +l_{n-1}+l_n)/(C_V\times d\times V\times 60\times 7850)} \tag{7}$$

The average temperature of the strip at each section is calculated as follows;

$$t_1 = (T_0 + T_1)/2 \tag{8}$$

$$t_2 = (T_1 + T_2)/2 \tag{9}$$

$$t_{n-1} = (T_{n-2} + T_{n-1})/2 \tag{10}$$

$$t_n = (T_{n-1} + T_n)/2 \tag{11}$$

The material balance on acid at a stationary state is as follows;

In the n-th section:

$$Q\times C_{n+1}=Q\times C_n+\gamma_n \tag{12}$$

In the (n−1)-th section:

$$Q\times C_n=Q\times C_{n-1}+\gamma_{n-1} \tag{13}$$

In the second section:

$$Q \times C_3 = Q \times C_2 + \gamma_2 \quad (14)$$

In the first section;

$$Q \times C_2 = Q \times C_1 + \gamma_1 \quad (15)$$

Wherein, $\gamma_n$ represents the rate of consumption of acid which may be converted to the rate of descaling $X_n$. For example, when the reaction equation is represented as follows:

$$FeO + 2HCl = FeCl_2 + H_2O \quad (16)$$

$$\gamma_n = X_n. \quad (17)$$

where the unit herein is (Kg/min.)

In the n-th section, Q and $C_{n+1}$ are preset values which are able to be optionally determined. Since $X_n$ is a function of $t_n$ and $C_n$, if this functional equation can be previously determined, equation (12) is an equation of the first degree on $C_n$ and therefore $C_n$ can be easily determined. And if $C_n$ is determined, $X_n$ can be determined from the functional equation of Tn and $C_n$ on Xn.

In the (n−1)-th section, when Q which can be optionally set, and $C_n$ determined in the n-th section, and tn−1 for $X_{n-1}$ and a functional equation of $C_{n-1}$ are substituted in equation (13), linear function for $C_{n-1}$ is given similarly to the case of the n-th section to determine easily $C_{n-1}$ Similarly, when $C_{n-1}$ is determined, $X_{n-1}$ can be easily determined from $t_{n-1}$ for $X_{n-1}$ and a functional equation of $C_{n-1}$. When the calculations above described are repeated in turn, the concentration distribution of acid $C_n$, $C_{n-1}$ . . . $C_1$ and quantity of descaling $X_n$, $X_{n-1}$ . . . $X_1$ in the pickling tank can be obtained. When the acid is, for example, hydrochloric acid and the steel is, for example, a plain carbon steel, functional equations $t_n$ and $C_n$ which are obtained under conditions of various temperatures and acid concentrations concerning $X_n$ can be given by the following equation $$X_n = 1.3328 \times 10^7 \times \exp^{(-7168/(273+t))} \times 1n \times h \times Cn \times 2 \quad (18)$$

In the case where another acid, for example, sulfuric acid is used, it is adequate that the descaling rate at various temperatures and concentrations in sulfuric acid art previously determined in a similar manner as above. The cumulative descaling rate Z can be determined by the following manner. That is to say, the quantity of descaling per unit area at each section is determined, and which is cumulated. The quantity of descaling per unit area at each section is as follows;

in the n-th section:

$$Y_n = X_n \times \tau_n / (1_n \times h \times 2) \quad (19)$$

in the (n−1)-th section:

$$Y_{n-1} = X_{n-1} \times \tau_{n-1} / (1_{n-1} \times h \times 2) \quad (20)$$

in the second section:

$$Y_2 = X_2 \times \tau_2 / (1_2 \times h \times 2) \quad (21)$$

in the first section:

$$Y_1 = X_1 \times \tau_1 / (1_1 \times h \times 2) \quad (22)$$

The cumulated descaling rate at each section is as follows; to the inlet of the first section:

$$Z_1 = Y_1 / X_0 \quad (23)$$

to the inlet of the second section:

$$Z_2 = (Y_1 + Y_2) / X_0 \quad (24)$$

to the inlet of the n-th section:

$$Z_n = (Y_1 + Y_2 + \cdots + Y_n) / X_0 \quad (25)$$

Accordingly, the cumulative descaling rate in the pickling tank can be controlled most appropriately by obtaining the cumulative descaling rate in the pickling tank by using the equations above described, and fed back to the parameters which are able to control it optionally so as to lead it to approximately 100% in the neighborhood of the outlet, that is, $t_n$, $C_{n+1}$, Q and V.

Also in the case where the state of operation of the plant, for example, line speed V, temperature of solution $\theta_f$, capacity of ARP $C_{n+1}$, and Q, and the state of steel strip, for example, width of the strip, quantity of scale, etc. are changed, each of these values can be set so as to lead the cumulative descaling rate to 100% in the neighborhood of the outlet by obtaining the cumulative descaling rate by using the algorithm described above and fed back to the parameters which are able to be controlled.

A judgement on which parameter should be changed is made depending upon the time required to revert the state to a stationary state after change of a specific parameter and uniformity of descaling. For example, in the case where V is changed, they are $C_{n+1}$, Q and $\theta_f$ which are able to be changed at that time.

The time required to reach a stationary state may be obtained by solving the following differential simultaneous equations;

$$V \cdot d\ C_n = Q \cdot C_{n+1} \cdot dt - Q \cdot C_n \cdot dt - \gamma_n \cdot dt \quad (26)$$

$$V \cdot d\ C_{n-1} = Q \cdot C_n \cdot dt - Q \cdot C_{n-1} \cdot dt - \gamma_{n-1} \cdot dt \quad (27)$$

$$V \cdot d\ C_1 = Q \cdot C_2 \cdot dt - Q \cdot C_1 \cdot dt - \gamma_1 \cdot dt \quad (28)$$

Uniformity of descaling may be examined by the distribution of the cumulative descaling rate in the pickling tank. That is to say, in the case where the cumulative descaling proceeds gradually as a steel strip advances through the pickling tank, descaling is performed uniformly, and, therefore, the surface roughness is small. Contrasting, in the case where the cumulative descaling increases steeply in a certain interval, descaling proceeds exceptionally steeply, and in that case the surface roughness is large.

According to the aforesaid procedures, the number of the optimum controlling parameters to be set can be determined and it can be also determined which parameter should be changed and to what extent the parameter should be changed in the case where the state of operation of the plant and the state of the steel strip to be treated are changed.

PREFERRED EMBODIMENTS OF THE INVENTION

Example 1

FIG. 1 shows a pickling apparatus equipped with the invention algorithm. In a monitoring unit 7, a lot of information on the thickness and width of the steel strip, initial temperature of steel strip, temperature of a hydrochloric acid solution, scale amount, line speed, concentration of the hydrochloric acid supplied from an ARP (an acid recovery system), and an amount of hydrochloric acid supplied from the ARP is put in the monitoring unit 7 through sensors 9, 10. The optimum operating conditions are calculated on the basis of the input data by using the algorithm of the invention in a calculating system 8, and fed back, and various kinds of operations, such as control of temperature of the acid solution, set of the line speed, set of the concentration of hydrochloric acid supplied, control of the hydrochloric acid supplied and the like are performed. The contents of the algorithm are previously described. The sensor 9 is for detecting the concentration and flow rate of the acid solution, the sensor 10 is for detecting the line speed and a film thickness gauge.

In the sensor 9, the concentration and amount of hydrochloric acid supplied are measured. The sensor 10 measures the thickness and width of the steel strip, initial temperature of steel strip 2, amount of scale, and line speed. The sensor 11 measures the temperature of solution.

The pickling apparatus comprises a catenary type pickling tank which consists of several (usually three or four) sectional tanks each of which is provided with a heater for the hydrochloric acid solution. A running steel strip to be treated is supported by a plurality of rollers which are disposed at end walls or partitions of the sectional pickling tanks respectively. The acid solution is caused so as to overflow the end wall of the respective sectional tanks and to flow toward a reverse direction to the running direction of the steel strip (i.e. from the downstream side toward the upstream side of the running steel strip) to ensure a high flow speed of the acid solution relative to the steel strip. Thus, the steel strip is in contact with the acid solution having a low acid concentration at the inlet of the pickling tank and has a low temperature since the steel strip is not yet heated enough by the acid solution. As the steel strip advances, it is brought into contact with the acid solution having a higher acid concentration and becomes to have substantially the same temperature as that of the acid solution.

In FIG. 1, the solid lines show a flow of solution and the dotted lines show a flow of information. Accordingly, the dotted line for the sensor 10 to the monitoring unit show a transfer of the results of measurements of the thickness and width of the steel strip, initial temperature of strip, amount of scale, and line speed. Similarly, the results of the measurements of the concentration and amount of hydrochloric acid supplied are transferred from the sensor 9.

The dotted lines from each section of tank show a transfer of the results of the measurements of the temperature of the solution. Each of values of the optimum parameters calculated through the monitoring unit in the operation system, providing the concentration and flow rate of the solution are the concentration of acid solution, is transferred through the monitoring unit to a flow rate controlling system 13 where new optimum values are set. Running speed of the steel strip is set in a similar manner at the optimum value in a strip running speed controlling unit 12.

Figure 2:
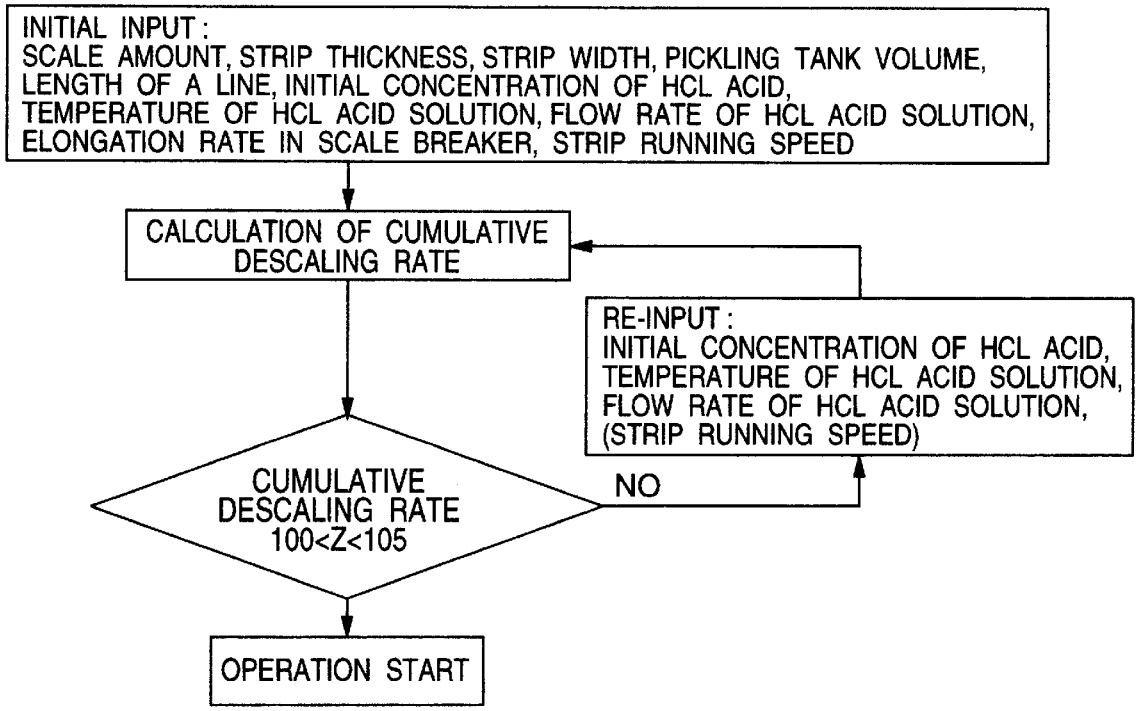
FIG. 2 is a flow chart showing an operation at the starting time of running the pickling plant.

FIG. 2 is a flow chart showing the procedures at the beginning of operation according to the present invention. The descaling rate at the inlet can be calculated by initial input of the parameters shown in the flow chart and then by making use of aforesaid equations (1) to (25). In the case where the value of the descaling rate is within the range of 100 to 105%, the operation is carried out under said conditions. When the value is beyond the aforesaid range, the initial concentration of hydrochloric acid (the concentration of hydrochloric acid supplied), the temperature of the solution, and the flow rate of the hydrochloric acid solution which are re-changeable parameters for operation are resupplied. In the case where an output is changeable, the strip running speed is also a changing parameter. And, the cumulative descaling rate is made to be recalculated.

Figure 3:
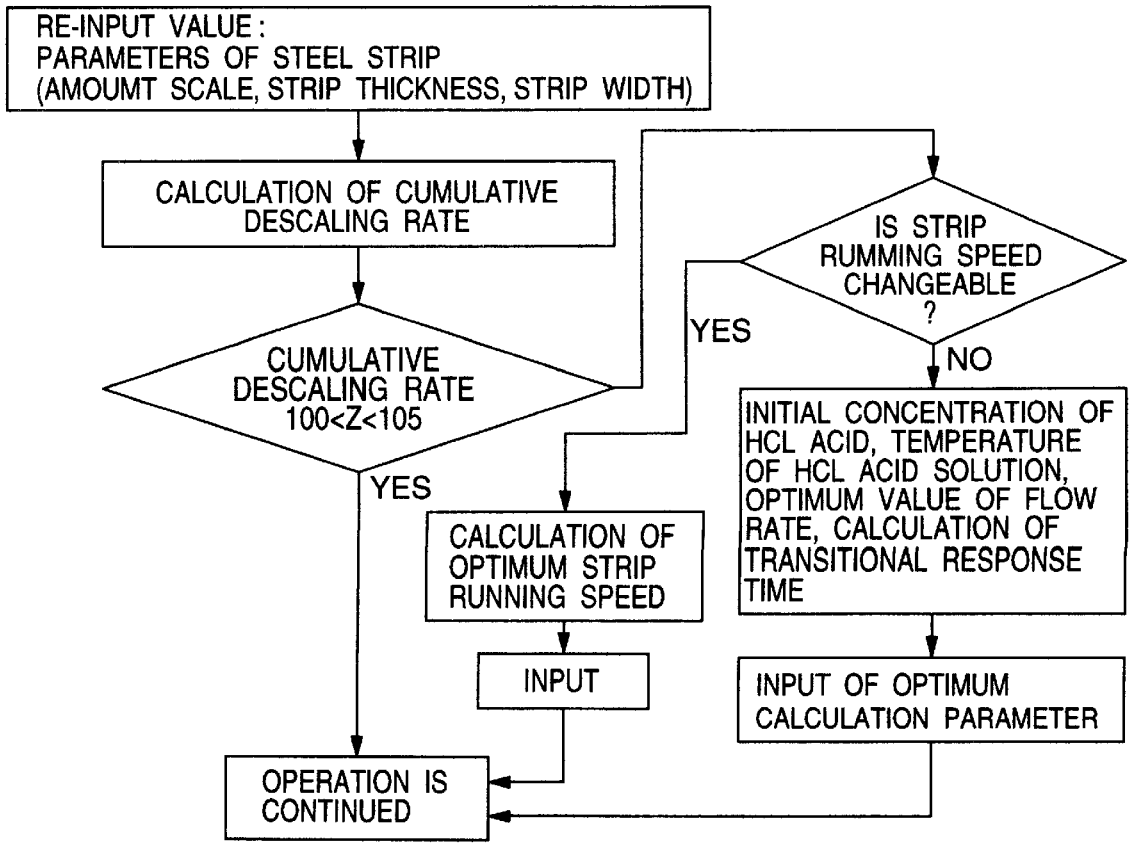
FIG. 3 is a flow chart showing an operation in the course of running the pickling plant.
Figure 4:
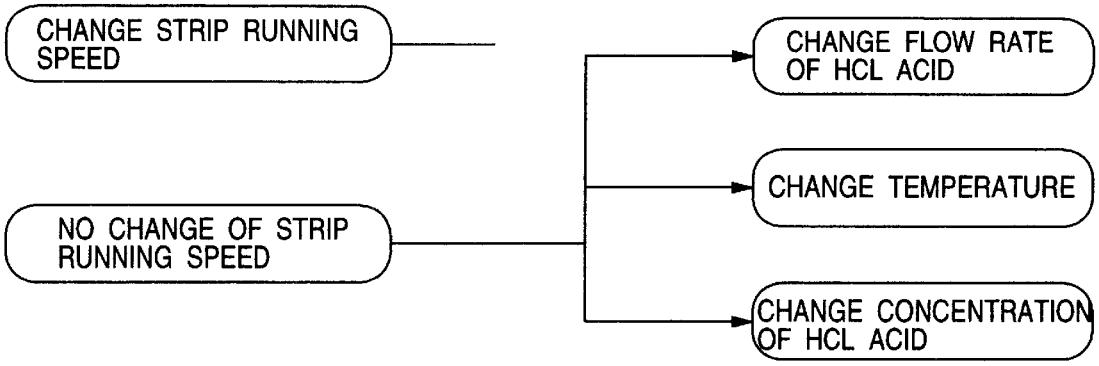
FIG. 4 shows parameters of operating conditions of the pickling plant.

FIG. 3 is a flow chart showing the procedures in the case where the parameter on the steel such as amount of scale etc. is changed in the course of operation. In the case where while the operation has been performed under such the conditions that the descaling rate is within a range of 100 to 105%, the operating conditions are changed to the operating conditon (1) shown in FIG. 4 for reason that, for example, the annealing condition is changed and amount of scale changes, the descaling rate is made to be recalculated. When the value of the descaling rate is within the range of 100 to 105%, the operation is continued with the parameters of operating conditions unchanged. When the value is out of the range, there occurs necessity for resetting the parameters for the operating conditions. A parameter which can be most easily changed in the operating parameters is a strip running speed.

Figure 5:
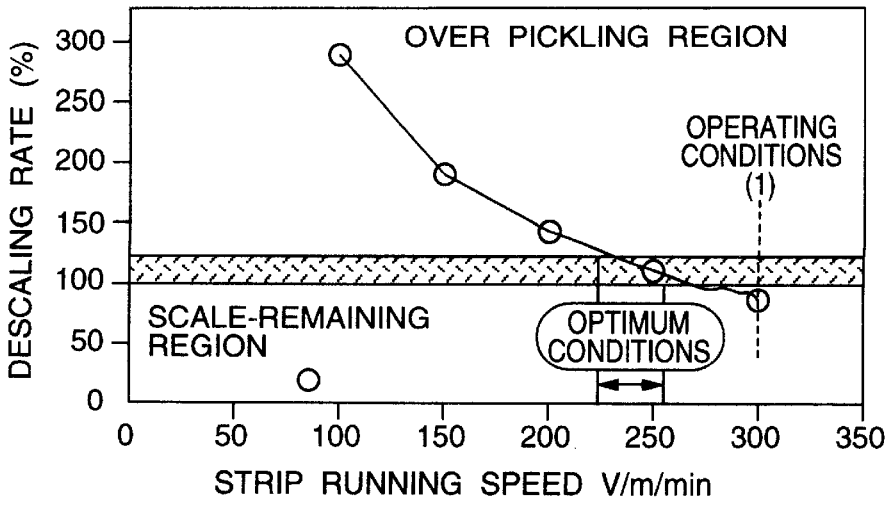
FIG. 5 is a diagram showing a relationship between a running speed of a steel strip in pickling treatment and a descaling rate (%)
Figure 6A:
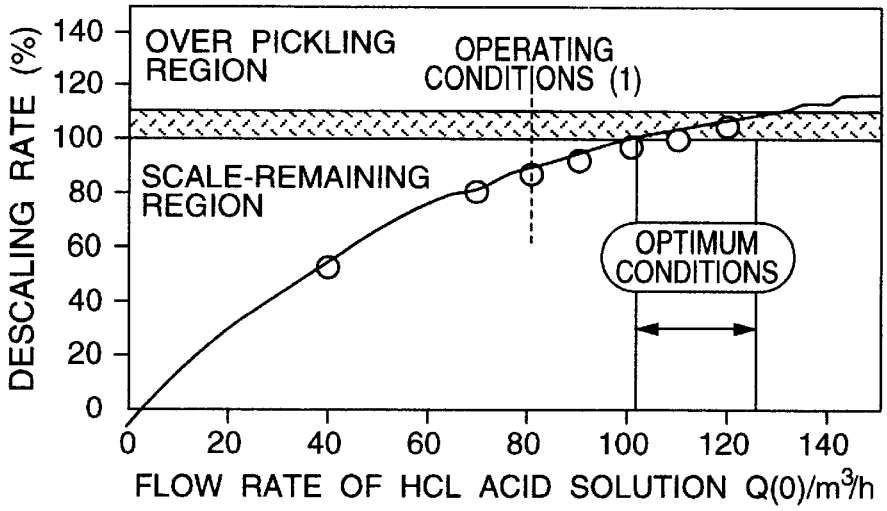
FIGS. 6A–6C are diagrams each showing a way of setting an optimum operating condition.
Figure 6B:
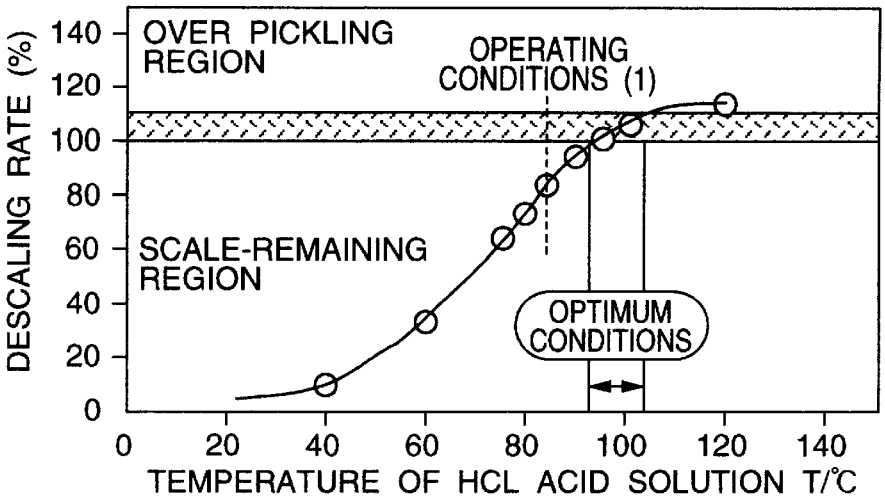
Figure 6C:
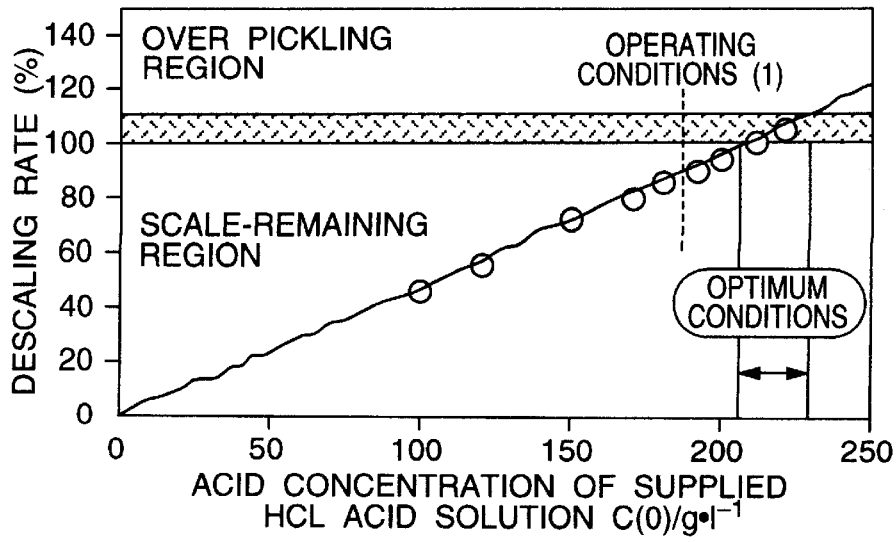

FIG. 5 shows a relationship between the strip running speed and the descaling rate (same as the cumulative descaling rate) which is obtained by calculation. Since the proper strip running speed is within the range of 225 to 252 m/min. from this relationship, the value is put in, and the operation is continued. In the case where the productivity can not be changed, that is, when the strip running speed can not be changed, other parameters, that is, the initial concentration of hydrochloric acid, the temperature of the solution and the flow rate of hydrochloric acid are changed. FIG. 6 shows the change of the descaling rate obtained by calculation when each of the values is changed. As shown in FIG. 6, the optimum set values when each of the procedures is performed can be determined. By performing the procedures, the transitional response time reaching the next stable state can be obtained by making use of the equations (26) to (28). The optimum method for controlling in which the transitional response time is short is preferable. However, in the case where the temperature of hydrochloric acid is above 100° C. as shown in FIG. 6 (*b*), the procedures are not feasible because of the performance of the apparatus, and which procedures are excluded. In FIG. 6 (*a*) shows the case where the flow rate of hydrochloric acid is changed, (*b*) shows the case where the temperature of hydrochloric acid is changed and (*c*) shows the case where the concentration of hydrochloric acid is changed.

Example 2

Figure 7:
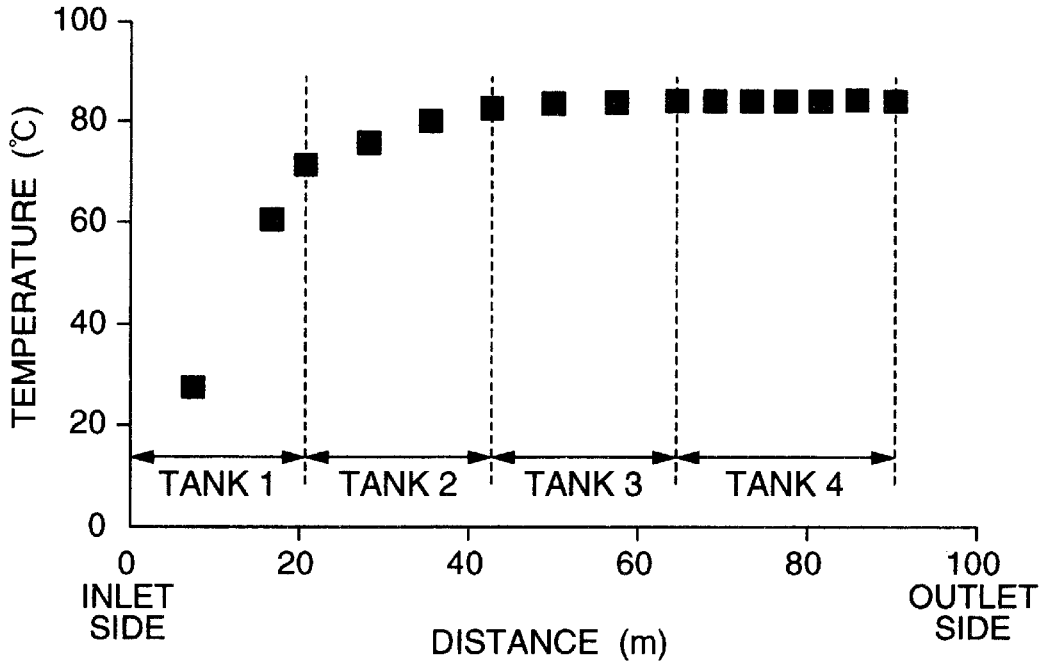
FIG. 7 is a diagram showing a temperature distribution of pickling tanks as a calculation result by means of an algorithm in accordance with the invention.
Figure 8:
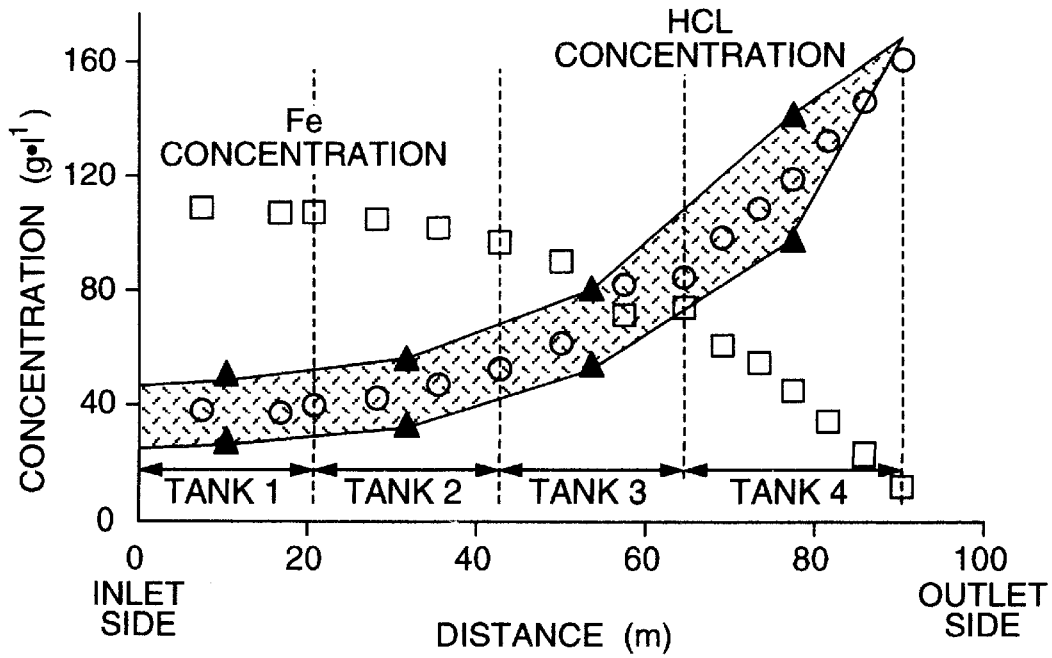
FIG. 8 is a diagram showing concentration distributions of HCl and Fe in the pickling tanks as a calculation result by means of an algorithm in accordance with the invention.
Figure 9:
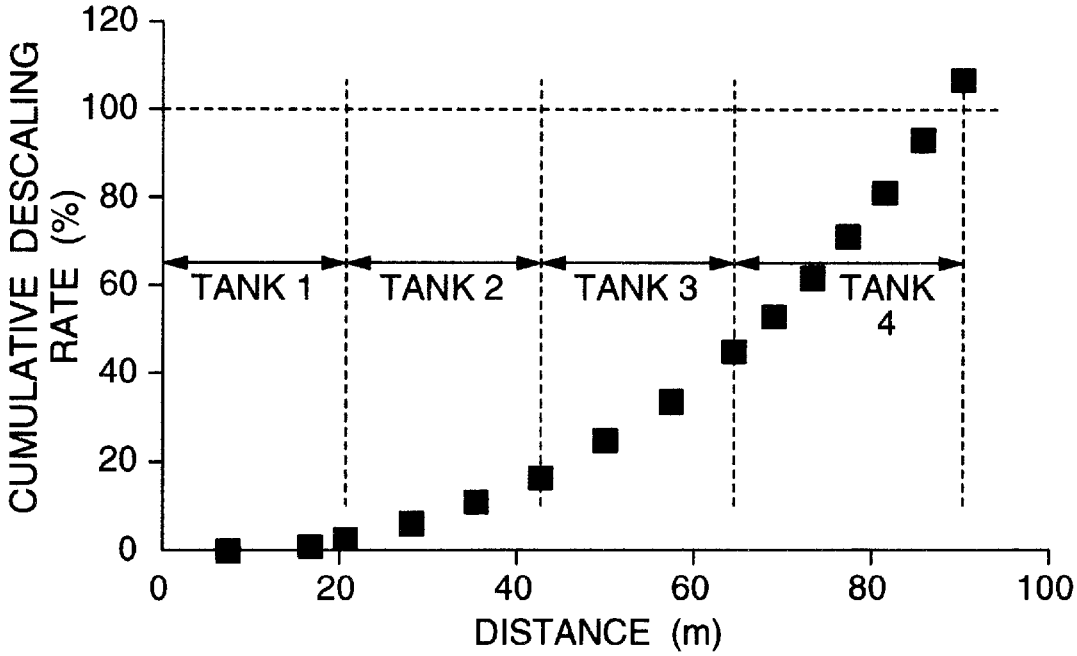
FIGS. 9–13 are diagrams each showing cumulative descaling efficiencies in the pickling tanks as a calculation result by means of an algorithm in accordance with the invention.
Figure 10:
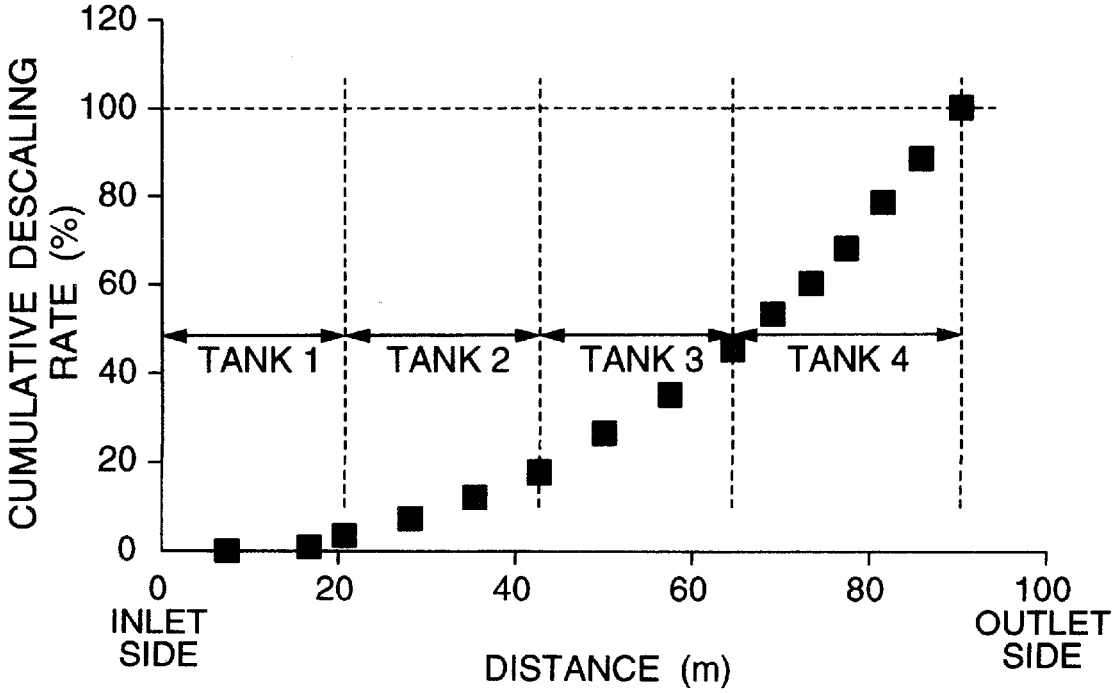

FIGS. 7 and 8 show the concentration of HCl, the concentration of Fe ion and temperature distribution in the pickling tanks which are obtained by substituting 10° C. of the initial temperature θ(0) of strip, 85° C. of temperature θ(f) of the solution, 0.07 kg/m$^2$ of scale amount X (0), 250 m/min. of the line speed V, 20000 kcal/m$^2$ h ° C. of the heat transfer coefficient α, 0.11 kcal/kg ° C. of the specific heat C (1) of strip, 20.7 m of the length of the first tank 1 (n), 21.75 m of the length of the second tank, 21.75 m of the length of the third tank, 26 m of the length of the fourth tank, 180 g/l of the concentration "d" of HCl supplied from the ARP, 80 kg/min. of the quantity Q of HCl supplied from the ARP, 1 m of width "h" of the steel strip and 0.0035 m of the thickness "t" of the steel strip which are operating conditions for operating the plant currently used in a stationary state in the algorithm of the present invention. Slant lines in the graph showing the concentration distribution represent the distribution of the concentration of HCl during operation of a practical plant. The concentration distribution of HCl obtained by the algorithm of the invention is well in agreement with that in the practical plant, and, as a result, it can be confirmed that the algorithm of the invention acts in a proper manner. The cumulative descaling rate at each point in the acid pickling tanks obtained by using the algorithm is shown in FIG. 9. As shown in FIG. 9, the cumulative descaling rate near the outlet of the acid pickling tanks is 110% which is in excess of 100% at the completion of descaling. Considering that the 100% indicates the time of completion of descaling, it is understood that such the operating conditions results in somewhat a state of over pickling. When a state of over pickling occurs, a base material of the strip is remarkably dissolved and the strip surface becomes rough to deteriorate the product value. It is, therefore, required that the cumulative descaling rate in the vicinity of the outlet is 100%. Accordingly, when, for example, the temperature is lowered, the cumulative descaling rate becomes as shown in FIG. 10 in which it is 100% at the outlet, and the over pickling can be decreased.

With utilization of the above actual data, a calculation is instantaneously conducted in accordance with the invention algorithm, and a thus obtained calculation result is fed back to the operating conditions so as to be able to operate the pickling plant system under optimum conditions so that a steel strip having a high quality of fully satisfactory surface roughness is achieved.

In other words, predetermined initial values or instant operational data of state of quantity are input into the calculating system of the pickling plant, and thereafter if the descaling rate exceeds 100%, a further calculation is conducted by means of the invention algorithm with utilization of a selected different temperature of the acid solution, which is one of operational state of quantities, from the instant temperature so as to obtain a descaling rate of 100%, Concentration distribution of acid In the n-th section:

$$C_n=Q\times C_{n+1}/(Q+799680000\times 2\times 1_n\times h\times \exp^{(-7168/(273+t_n))})$$

In the (n−1)-th section:

$$C_{n-1}=Q\times C_n/(Q+799680000\times 2\times 1_{n-1}\times h\times \exp^{(-7168/(273+t_{n-1}))})$$

In the second section:

$$C_2=Q\times C_3/(Q+799680000\times 2\times 1_2\times h\times \exp^{(-7168/(273+t_2))})$$

In the first section:

$$C_1=Q\times C_2/(Q+799680000\times 2\times 1_1\times h\times \exp^{(-7168/(273+t_1))})$$

Concentration distribution of Fe

In the n-th section:

$$D_n=(C_{n+1}-C_n)\times 56/72$$

In the (n−1)-th section:

$$D_{n-1}=(C_{n-1}-C_{n-1})\times 56/72$$

In the second section:

$$D_2=(C_{n+1}-C_2)\times 56/72$$

In the first section:

$$D_1=(C_{n+1}-C_1)\times 56/72$$

Example 3

Figure 11:
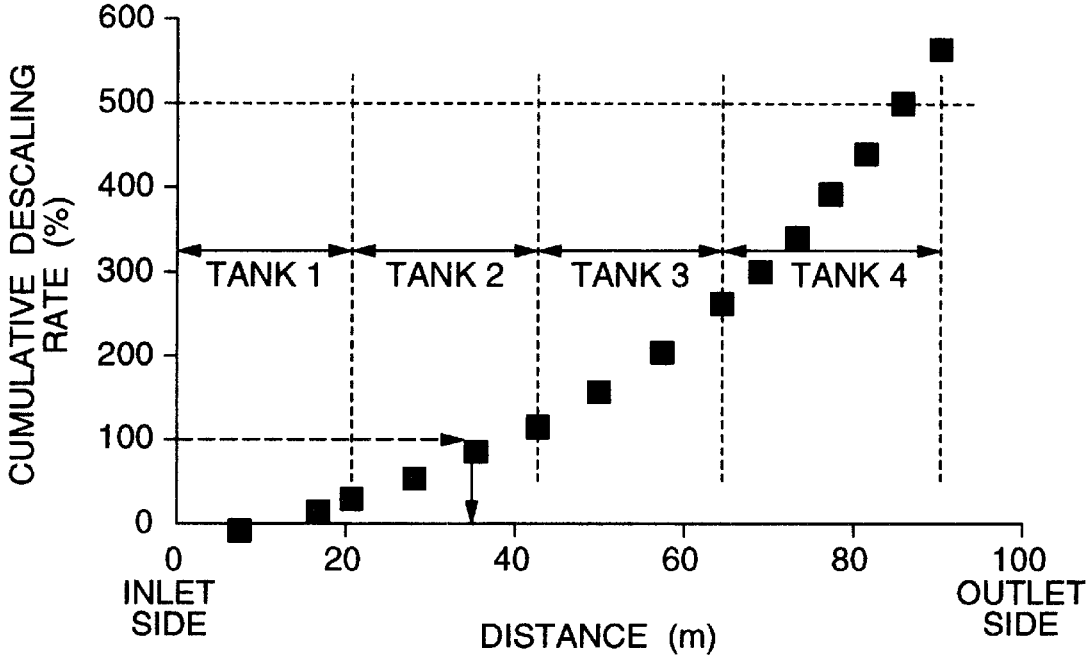
Figure 12:
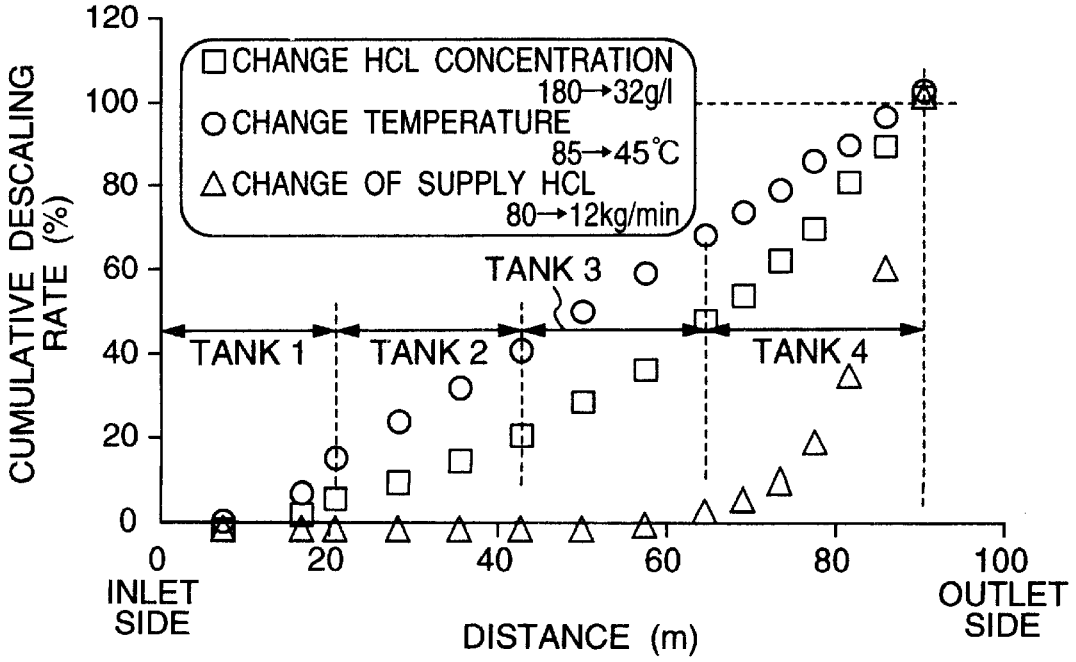

It is understood that in the case where the line speed is reduced to 50 m/min. during the operation of the pickling plant under the conditions shown in FIGS. 7 and 8 and the operation is continued under such conditions, the pickling is so remarkable that the cumulative descaling rate exceeds 100% already near at the downstream side of the second tank and goes up to 580% at the outlet according to the calculation by using the algorithm of the present invention as shown in FIG. 11. The treatments to be adopted in this case may be procedures such as (1) changing of the concentration of hydrochloric acid from the ARP, (2) changing of the temperature of the solution, (3) changing of the amount of hydrochloric acid supplied from the ARP, and the like. FIG. 12 shows a result of calculation by using the algorithm of the present invention so that the cumulative descaling rate near at the outlet is brought to be around 100% by the above three procedures (1), (2) and (3). According to the procedure (1), a value 180 g/liter is needed to change into 32 g/liter. According to the procedure (2), a value 85° C. is needed to change into 45° C. And according to the procedure (3), a value 80 kg/min. is needed to change into 12 kg/min. FIG. 11 shows the cumulative descaling efficiencies at each portion in the acid pickling tanks when the procedures (1), (2) and (3) are adopted. It is understood that while the descaling proceeds at constant rate in the acid pickling tanks in the procedures (1) and (2), the descaling is scarcely performed in an initial stage, but the cumulative descaling rate rises steeply at the rear end of the acid pickling tank in the procedure (3) to perform the descaling in an extremely short time. Since the procedure (3) is not proper because of surface roughness, it can be judged that the plant should not be controlled by the procedure (3). Comparing the procedures (1) and (2), the times required for returning the states after the procedures (1) and (2) are finished to stationary states which are calculated by using the algorithm of the present invention are 15 minutes and 80 minutes in the procedures (1) and (2), respectively. From the results described above collectively, it is apparent that the procedure (1) is the most appropriate.

With utilization of the above actual data, a calculation is instantaneously conducted in accordance with the invention algorithm, and a thus obtained calculation result is fed back to the operating conditions so as to be able to operate the pickling plant system under optimum condtions so that a steel strip having a high quality of fully satisfactory surface roughness is achieved.

In other words, predetermined initial values are input into the calculating system of the pickling plant, and thereafter if the descaling rate exceeds 100%, a further calculation is conducted by means of the invention algorithm with regard to which parameters should be changed and how amounts they should be changed, which are temperature, a flow speed and an acid concentration of the acid solution, and a running speed of the steel strip, and with regard to how long time it is needed to become stable in operation under an expected operation under the changed parameters, thereby the pickling plant is controlled on the basis of thus obtained optimum parameters (i.e. operational state of quantities).

Example 4

Figure 13:
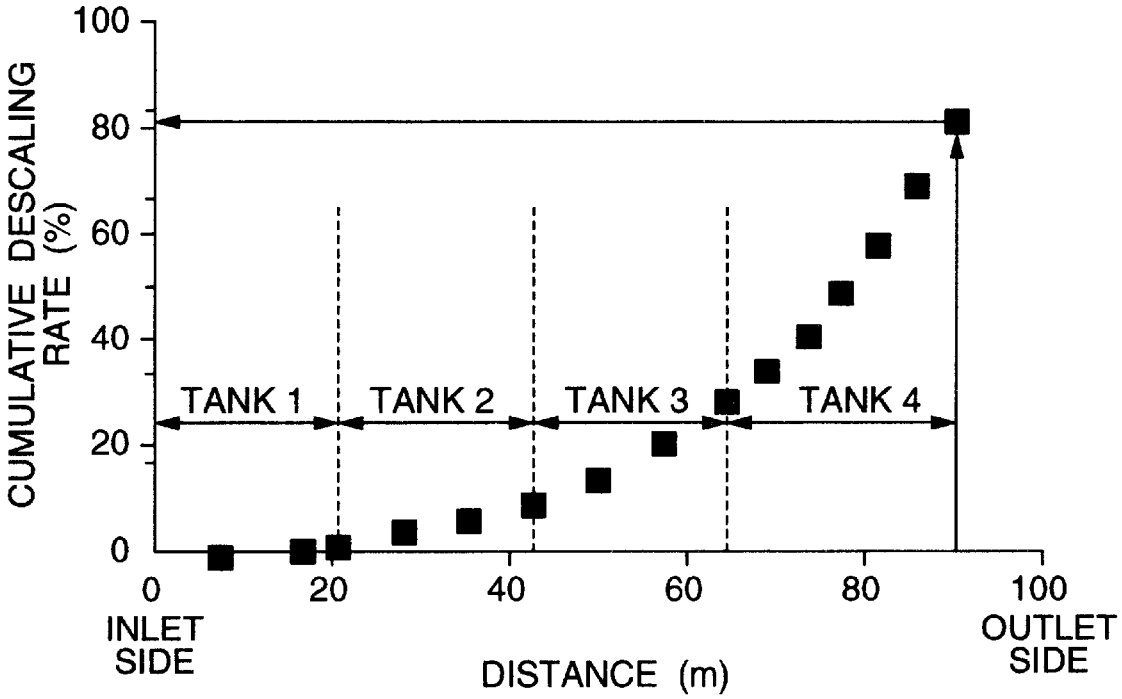

It is understood that in the case where the width of the steel strip is changed from 1 m to 1.5 m during the operation of the pickling plant under the conditions shown in FIGS. 7 and 8 and the operation is continued under such conditions, the cumulative descaling rate at the outlet of the pickling tank which is calculated by using the algorithm of the present invention is 81.6% (see FIG. 13) and the descaling is not yet complete. The treatments to be adopted in this case may be procedures such as (1) changing of the concentration of hydrochloric acid supplied from the ARP, (2) changing of the temperature of the solution, (3) changing of the amount of hydrochloric acid supplied from the ARP, (4) changing of the line speed, and the like. Similarly to Example 3, when the values which should be set so as to maintain the cumulative descaling rate near the outlet at around 100% by the four procedures (1), (2), (3) and (4) are calculated by using the algorithm of the present invention, 180 g/liter goes up to 225 g/liter in the procedure (1), 85° C. goes up to 100° C. in the procedure (2), 80 kg/min. goes up to 108 kg/min. in the procedure (3), and 250 m/min. lower to 205 m/min. in the procedure (4). Similarly to Example 2, taking the factors such as the cumulative descaling rate, the time required for returning the state to a stationary state, etc. into consideration, it is understood that the descaling is not finished when the temperature is risen to 100° C. in the procedure (1) and that a great load is charged to the ARP in the procedures (2) and (3). And, it results in an increase of damage to the ARP to increase the concentration. From the matters described above collectively, it is apparent that the procedure (4) is the most appropriate. These are arithmetically and logically operated by using algorithms of the present invention to obtain in a moment the optimum controlling method and optimum values for controlling which are fed back the operating conditions. According to the optimum controlling method and optimum values for controlling, the operation can be carried out under the optimum conditions to produce a steel strip of high quality having a lower level surface roughness.

Example 5

FIGS. 14 to 17 are block diagrams showing a continuous through production facility for cold rolling a hot rolled plain carbon steel strip after pickling.

Figure 14:
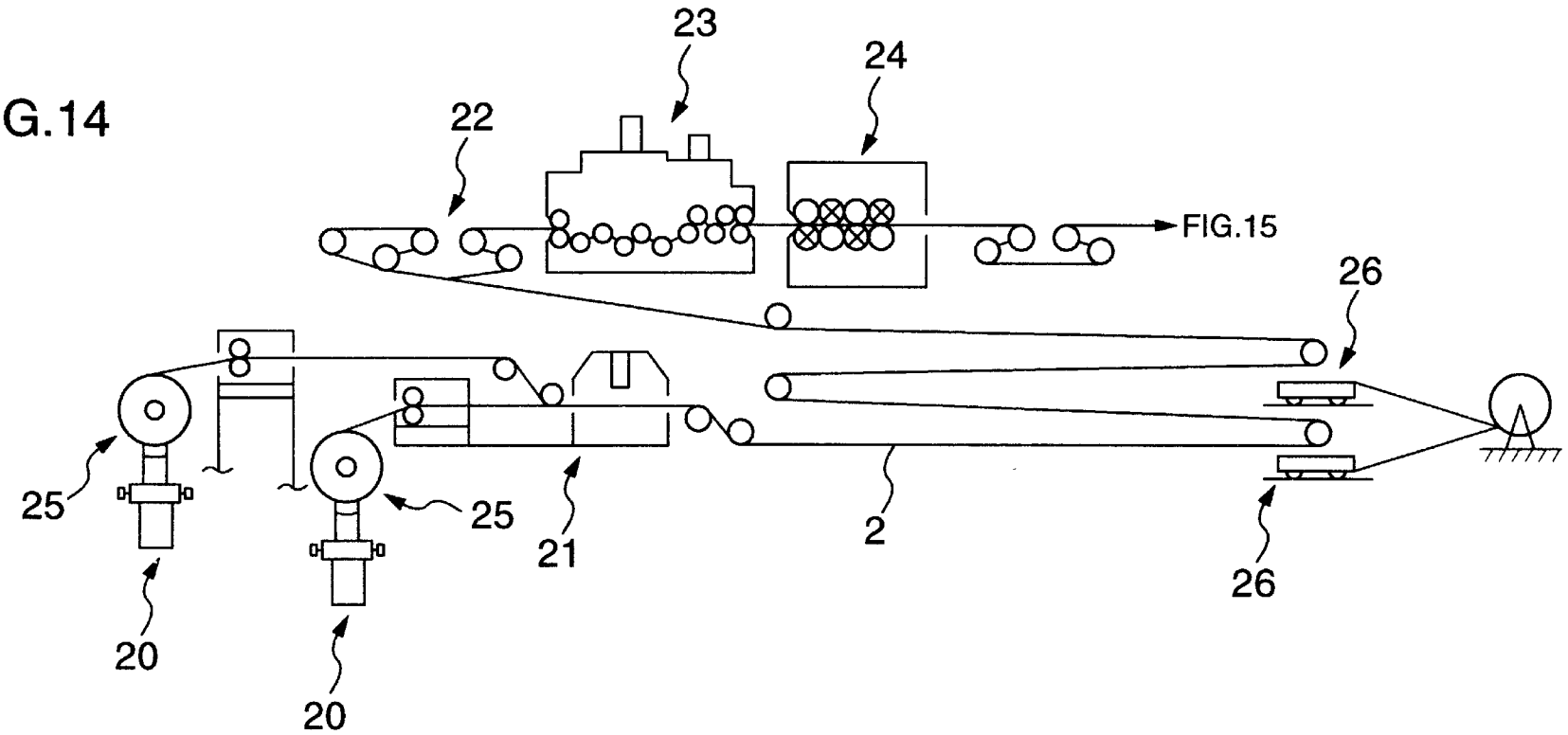
FIGS. 14–17 are schematic views each showing a continuous through production equipment of descaling and cold rolling as one embodiment of the invention.
Figure 15:
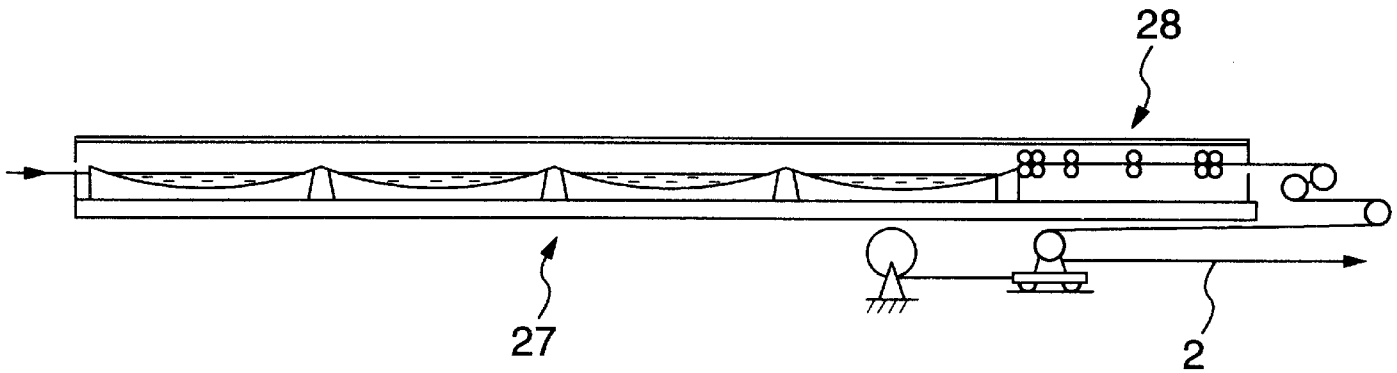

In the facility shown in FIG. 14, two separate steel strips wound around two coil cars 20, each having a pay off reel 25, at the inlet side of the line are welded together by means of a welder 21 to feed the steel strip continuously, then crackings are provided to scale on the steel strip by means of bridle rolls 22, then the steel strip thus treated is passed through the rolls, having small curvature radius, of a mechanical scale breaker 23 for removing the scale from the steel strip and a mechanical brush device 24 to scrape off the scale on the steel strip, and finally transferred to an acid pickling apparatus 27 shown in FIG. 15. In FIG. 14, reference numerals 26 denote looping cars.

The pickling apparatus 27 is the same as shown in FIG. 1. As described previously, since the descaling can be performed in the present embodiment at a high speed descaling rate of 500 m/min. or more, the cold rolling shown in FIG. 16 can be carried out continuously. In FIG. 15, reference numerals 28 denote a side trimmer.

Figure 16:
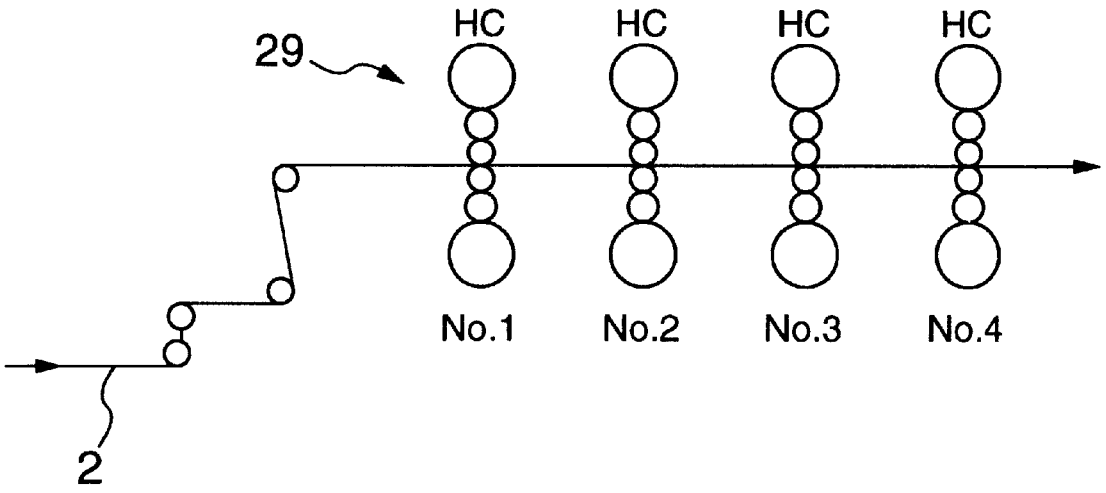

In FIG. 16, the steel strip is passed through a centering machine (not shown) and subsequently the four stands HC mills 29 arranged in tandem to produce a sheet steel strip. The each HC mill has two pairs of back up rolls, working rolls and intermediate rolls therebetween, in which since the intermediate rolls can be shifted in axial opposite directions of right and left sides, respectively, a steel strip having a uniform thickness can be produced. In the cold strip mill used in the present embodiment, a UC mill, CVC mill, cross mill or a combination thereof may be also used other than the HC mills. A combination of the CVC mill as a front stand with the HC mill as a rear stand, or a combination of the cross mill as a front stand with the HC mill as a rear stand may be exemplified.

Rolling can be performed more rapidly by using a composite roll as work rolls, intermediate rolls and back up rolls respectively in the present embodiment. The composite roll comprises a base or core material and an overlay comprising fine carbide of high alloy steel having wear resistance higher than that of the base material which is formed on the surface of the base material by electro-slag overlaying welding. An alloy steel comprising, by weight, 0.2 to 1.5% C, not more than 3% Si, not more than 2% Mn and not more than 5% Cr, optionally comprising not more than 0.5% Ni and/or not more than 1% Mo may be used for the base material. The overlay is made of a high alloy steel comprising, by weight, 0.5 to 1.5% C, not more than 3% Si, not more than 2% Mn, 2 to 10% Cr, 1 to 10% Mo, not more than 20% W, 1 to 5% V, and not more than 13% Co, which is subjected to low frequency surface heating and quenching followed by forcibly quenching and tempering so as to have a hardness of not less than HS 80.

The high alloy steel having a hardness of not less than HS 80 is used for working rolls, intermediate rolls have a lower hardness than that of the working rolls, and, regarding back up rolls, quantity of alloying elements is controlled so that the hardness of the back up rolls is lower than that of the intermediate rolls. In each roll of the intermediate rolls and back up rolls, it is better to lower HS hardness within a range of 5 to 10.

Each mill consists of four or six rolls. Although the diameters of the working rolls and intermediate rolls are identical with each other, the back up rolls the diameter of which is larger than those are used.

Figure 17:
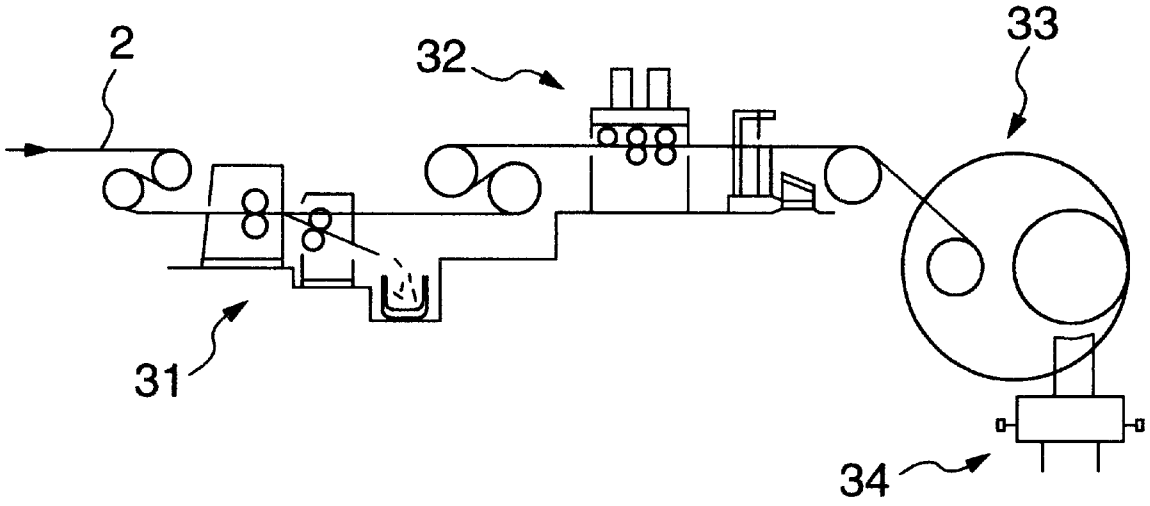

FIG. 17 is a block diagram showing an apparatus for winding a cold rolled steel strip by means of a coil car 34 at the outlet side. The steel strip is sheared and chopped appropriately by means of a rotary type scrap chopper 31 and wound by a Carrousel tension reel 33 through an oiler 32. Also in the present embodiment, the scale can be entirely removed and the steel strip without a rough surface can be obtained.

Example 6

Figure 18:
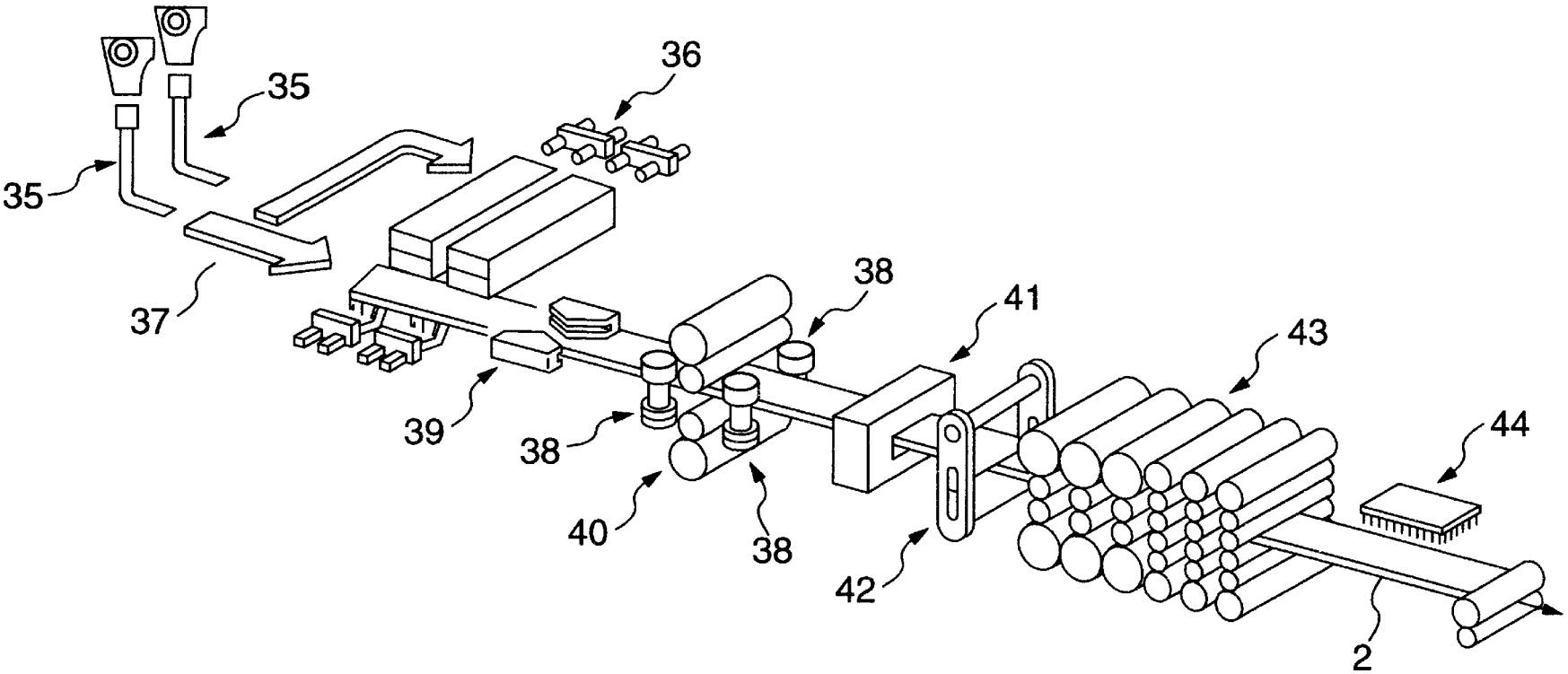
FIG. 18 is a perspective view showing a continuous through production equipment of continuous casting and hot rolling as one embodiment of the invention.
Figure 19:
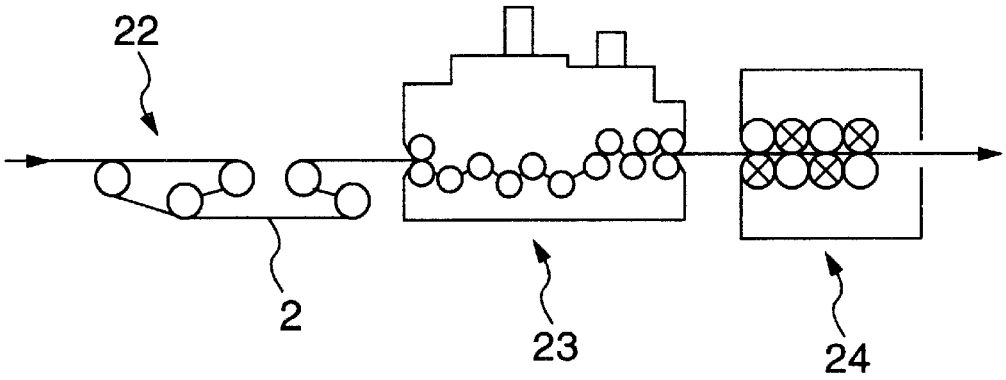
FIG. 19 is a schematic view showing a mechanical descaling equipment as one embodiment of the invention.

FIG. 18 shows a block diagram showing a through production equipment for continuous casting followed by hot rolling, in which a sheet steel strip 20 to 40 mm in thickness is continuously produced by using two continuous casting machines 35 alternately and subsequently hot rolling continuously 37 without cooling. The thin steel strip casted by the two continuous casting machines is transferred to a roughing rolling mill 40 alternately through a transfer machine 36. The thin steel strip fed to the roughing rolling mill is also passed through edgers 38, subsequently is heated by an edge heater 41, and is sheared properly by a shear machine 42, and then is hot-rolled by the HC mills 43. The thin steel strip thus hot rolled is cooled through a cooling apparatus 44, and is transferred to the pickling plant shown in FIG. 1 through bridle rolls 22, mechanical scale breaker 23 and mechanical brushes 24, as shown in FIG. 19. In the case where the speed of the continuous casting machine does not reach the speed of the pickling plant, the thin steel strip is wound by Carrousel tension reel through the cooling apparatus after hot rolling, and then is subjected to the pickling step described in Examples 1 to 4. In FIG. 18, reference numerals 39 denote a sizing press.

In the present embodiment, similar to Example 1, the scale can be entirely removed and a thin steel strip without roughness skin can be obtained.

In the continuous casting machine used in the present embodiment, there may be adopted a process in which a molten metal is poured into a casting mold equipped with a side edge casting mold between the cooled steel belts, or a process in which the side edge casting mold is mounted between wide casting molds and a thin steel strip is casted in high speed by vibrating it in the direction of casting. And, the composite rolls described in Example 5 may be used as rolls for rolling.

In the present embodiment, the steel strip is wound around a reel after pickling of the hot rolled strip. However, as shown in FIGS. 16 and 17 of Example 5, it is also possible that the steel strip from the continuous casting machine is continuously subjected to mechanical descaling, pickling, cold rolling and winding to a coil. Thereby, a production of high efficiency is performed.

As will be apparent from the above, according to the invention not only an operation can be performed by the optimum operating conditions for removing the oxides scale produced on the surface of hot rolled plain carbon steel strip, but also, as a result, an effect can be obtained that a plain carbon steel strip the surface appearance of which is fine can be obtained.

What is claimed is:

1. A method of controlling a pickling plant having a pickling tank containing a acid solution, through which a steel strip is passed, comprising the steps of:

calculating at least one of a concentration of the acid solution, a concentration of iron in the acid solution, and a descaling rate of the steel strip, at respective positions in the pickling tank, thereby providing calculation results at said respective positions; and controlling, on the basis of the calculation results, at least one of concentration of a supply acid which is supplied into the pickling tank, amount of supply acid added to the pickling tank, temperature of the supply acid, a line speed of the steel strip, and temperature of the steel strip just prior to entering the pickling tank.

2. The method according to claim 1, wherein the pickling tank has an outlet, and the at least one of the concentration of the supply acid, amount of the supply acid, temperature of the supply acid, line speed of the steel strip and the temperature of the steel strip just before entering the pickling tank, is controlled so that a cumulative descaling rate at the pickling tank outlet is about 100%.

3. The method according to claim 1, wherein, in the controlling step, at least one of the concentration of the supply acid, amount of the supply acid, temperature of the supply acid, and the line speed, is controlled.

4. A method of controlling a pickling plant having a pickling tank containing an acid solution, through which a steel strip is passed, comprising the steps of:

calculating an amount of acid consumed in the pickling tank, on a basis of a relationship between amounts of acid flowing into respective positions in the pickling tank and acid flowing out of the respective positions in the pickling tank, thereby providing first calculation results;

calculating at least one of a concentration of the acid solution, a concentration of iron in the acid solution, and a descaling rate of the steel strip, at said respective positions in the pickling tank, thereby providing second calculation results; and controlling, on the basis of the first and second calculation results, at least one of a concentration of a supply acid supplied to the pickling tank, amount of supply acid added to the pickling tank, temperature of the supply acid, line speed of the steel strip, and temperature of the steel strip just prior to entering the pickling tank.

5. A pickling plant having a pickling tank containing an acid solution, through which a steel strip is passed, comprising:

a calculator which calculates an amount of acid consumed in the pickling tank, on the basis of a relationship between amounts of an acid flowing into respective positions in the pickling tank and acids flowing out of the respective positions in the pickling tank, thereby providing calculation results; and a control device which controls, on the basis of the calculation results, at least one of concentration of a supply acid supplied to the pickling tank, amount of the supply acid, temperature of the supply acid, a line speed of the steel strip passed through the acid solution, and temperature of the steel strip just prior to entering the pickling tank.

6. Descaling equipment for a hot-rolled plain carbon steel strip, comprising:

a shearing device for shearing the steel strip to have a length;

means for providing mechanical stress to scale on the steel strip;

a plurality of tanks containing an acid solution which is brought into contact with the steel strip;

a pickling plant in which the steel strip is descaled by dipping and passing the steel strip in and through the acid solution in the tanks, wherein the pickling plant is that defined in claim 5;

water-cleaning means for cleaning the steel strip after passing through the pickling plant, thereby providing a water-cleaned steel strip; and drying means for drying the water-cleaned steel strip.

7. Equipment for continuous through production by descaling and cold rolling of a plain carbon steel strip, comprising:

a mechanical scale breaker by which the steel strip is mechanically descaled;

a pickling plant comprising a plurality of pickling tanks, each of which contains a dilute hydrochloric acid solution, said pickling plant further comprising means for causing the dilute hydrochloric acid solution to flow from a downstream side to an upstream side in the respective pickling tanks with respect to a running direction of the steel strip, the pickling plant being the pickling plant according to claim 5; and a cold strip mill for rolling the steel strip after passing through the pickling plant.

8. Equipment for continuously descaling plain carbon steel, comprising:

a continuous casting machine for producing a thin plate casting of plain carbon steel;

a hot strip mill for rolling the thin plate casting, thereby providing a hot-rolled plain carbon steel strip;

a mechanical scale breaker for mechanically descaling the hot-rolled plain carbon steel strip;

a pickling plant comprising a plurality of pickling tanks each of which contains a dilute hydrochloric acid solution, means for dipping and passing mechanically descaled plain carbon steel strip in and through the pickling tanks, heating means for heating the dilute hydrochloric acid solution in the pickling tanks, and means for causing the dilute hydrochloric acid solution to flow from a downstream side to an upstream side in respective pickling tanks with respect to a running direction of the steel strip through the pickling tanks, the pickling plant being that defined in claim 5;

water-cleaning means for cleaning the steel strip after passing through the pickling plant, thereby providing a water-cleaned steel strip; and drying means for drying the water-cleaned steel strip.

9. Equipment according to claim 8, further comprising a cold strip mill for rolling the plain carbon steel strip which has been dried in said drying means.

10. A pickling plant having a pickling tank containing an acid solution, through which a steel strip is passed, comprising:

a calculator which calculates at least one of a concentration of the acid solution, a concentration of iron in the acid solution and a descaling rate of the steel strip, at respective positions in the pickling tank, thereby providing calculation results; and a control device which controls, on the basis of the calculation results, at least one of a concentration of a supply acid supplied to the pickling tank, amount of the supply acid, temperature of the supply acid, a line speed of the steel strip passed through the acid solution, and temperature of the steel strip just before entering the pickling tank.

11. A method of controlling a pickling plant having a pickling tank containing an acid solution, through which a steel strip is passed, comprising the steps of:

calculating an amount of acid consumed in the pickling tank, on a basis of a relationship between amounts of acid flowing into respective positions in the pickling tank and acid flowing out of the respective positions in the pickling tank, thereby providing calculation results; and controlling, on the basis of the calculation results, at least one of a concentration of a supply acid supplied to the pickling tank, an amount of the supply acid added to the pickling tank, temperature of the supply acid and a line speed of the steel strip.

12. A method of controlling a pickling plant, in which a steel strip is descaled by pickling, comprising the steps of:

producing the steel strip by hot-rolling, utilizing a hot strip mill; and pickling the steel strip, the pickling being carried out in a pickling plant, said pickling plant being controlled by the method of any one of claims 1, 4 or 11, wherein said steel strip is a plain carbon steel strip.

13. A process for continuously producing the steel strip by descaling and rolling the steel strip, comprising the steps of:

producing the steel strip by hot-rolling, using a hot strip mill; and descaling the steel strip by pickling, the pickling being performed in a pickling plant having a pickling tank containing an acid solution through which the steel strip is passed, said pickling plant being controlled by a method according to any one of claims 1, 4 or 11, wherein the steel strip is a plain carbon steel strip.

14. A process of descaling and rolling a steel strip by a continuous through production process, comprising the steps of:

producing the steel strip by hot-rolling, using a hot strip mill, to form a hot-rolled steel strip;

mechanically descaling the hot-rolled steel strip, to form a mechanically descaled, hot-rolled steel strip; and thereafter, further descaling the mechanically descaled, hot-rolled steel strip by pickling, utilizing a pickling plant having a pickling tank containing an acid solution through which the steel strip is passed, the pickling plant being controlled during the pickling by the method recited in any one of claims 1, 4 or 11, thereby providing a descaled steel strip; and subjecting the descaled steel strip to cold-rolling, wherein the steel strip is a plain carbon steel strip.

* * * * *